US008240374B2

(12) United States Patent
Turick et al.

(10) Patent No.: US 8,240,374 B2
(45) Date of Patent: Aug. 14, 2012

(54) APPARATUS AND METHODS FOR LIMITING DEBRIS FLOW BACK INTO AN UNDERGROUND BASE PIPE OF AN INJECTION WELL

(75) Inventors: Daniel James Turick, Houston, TX (US); James Raymond Macias, Al Sitra (BH)

(73) Assignee: Superior Energy Services, L.L.C., Harvey, LA (US)

( * ) Notice: Subject to any disclaimer, the term of this patent is extended or adjusted under 35 U.S.C. 154(b) by 0 days.

(21) Appl. No.: 12/853,443

(22) Filed: Aug. 10, 2010

(65) Prior Publication Data

US 2010/0300692 A1 Dec. 2, 2010

Related U.S. Application Data

(62) Division of application No. 11/724,434, filed on Mar. 15, 2007, now Pat. No. 7,793,716.

(60) Provisional application No. 60/794,282, filed on Apr. 21, 2006.

(51) Int. Cl.
*E21B 43/08* (2006.01)

(52) U.S. Cl. ..... 166/205; 166/227; 166/305.1

(58) Field of Classification Search ..... 166/305.1, 166/306, 51, 56, 205, 227, 235, 236
See application file for complete search history.

(56) References Cited

U.S. PATENT DOCUMENTS 3,442,333 A 5/1969 Meldau
4,733,723 A * 3/1988 Callegari, Sr. ..... 166/51
5,174,161 A 12/1992 Veneruso et al.
5,842,516 A 12/1998 Jones
5,979,551 A 11/1999 Uban et al.
6,834,720 B1 12/2004 Dwyer et al.
6,886,634 B2 * 5/2005 Richards ..... 166/278
7,055,598 B2 6/2006 Ross et al.
2003/0173086 A1 9/2003 Howard et al.
2004/0149435 A1 8/2004 Henderson
2005/0034859 A1 2/2005 Callier
2006/0266524 A1 11/2006 Dybevik

OTHER PUBLICATIONS

"OTS Heavy Oil Science Centre—Completions and Workovers"; 7 pgs.; http://www.lloydminsterheavyoil.com/completi.htm.

"Operational Mangement: Horizontal Well Completion Techniques"; PTTC West Coast Region; 5 pgs.; http://www.westcoastpttc.org/research.operatio.htm.

Singh, et al; "Cost Analysis of Advanced Technologies for Production of Heavy Oil and Bitumen in West Canada"; Alberta, Canada; 19 pgs.; World Energy Council http://www.worldenergy.org.

Simpson, Robert; "Imperial Oil Resources"; 2 pgs.; Alberta Chamber of Resources http://www.acr-alberta.com.

"Imperial Oil to make application for further expansion at Cold Lake"; 2 pgs.

(Continued)

*Primary Examiner* — Brad Harcourt
(74) *Attorney, Agent, or Firm* — Jones, Alker, Waechter, Poitevent, Carrere & Denegre, L.L.P.

(57) ABSTRACT

In some embodiments, apparatus for assisting in reducing flowback of debris from an earthen formation into an underground fluid injection system includes a screen member disposed around and longitudinally moveable relative to a base pipe and shielded from direct contact with fluid as it is ejected from the base pipe.

16 Claims, 4 Drawing Sheets

OTHER PUBLICATIONS

Boone et al; "Targeted Steam Injection Using Horizontal Wells with Limited Entry Perforations"; Paper No. 50429; SPE Intl. Conf. on Horizontal Well Technology, Nov. 1-4, Calgary, Alberta, Canada; 1998; 2 pgs.

Smith et al; "Steam Conformance Along Horizontal Wells at Cold Lake"; Paper No. 79009; SPE Intl. Thermal Optns. and Heavy Oil Symposium and Intl. Horizontal Well Technology Conf., Nov. 4-7, Calgary, Alberta, Canada; 2002; 2 pgs.

Buckles, R.S.; "Steam Stimulation Heavy Oil Recovery at Cold Lake, Alberta"; Paper No. 7994; SPE California Regional Meeting, Apr. 18-20, Ventura California; 1979; 2 pgs.

Meyer et al; "Heavy Oil and Natural Bitumen—Strategic Petroleum Resources"; U.S. Geological Survey Fact Sheet 70-03; Aug. 2003; 5 pgs.

Cook, Lynn J.; "Oil's Newest Frontier"; Houston Chronicle, Houston, TX; Nov. 6, 2005; 3 pgs.

* cited by examiner

APPARATUS AND METHODS FOR LIMITING DEBRIS FLOW BACK INTO AN UNDERGROUND BASE PIPE OF AN INJECTION WELL

This application is a divisional application of and claims priority to U.S. patent application Ser. No. 11/724,434, filed Mar. 15, 2007 and entitled Apparatus and Methods for Limiting Debris Flow Back into an Underground Base Pipe of an Injection Well, and also claims priority to U.S. Provisional application Ser. No. 60/794,282 filed Apr. 21, 2006 and entitled Apparatus and Methods for Limiting Debris Flow Back into an Underground Base Pipe of an Injection Well, the entire disclosures of which is hereby incorporated by reference herein in their entireties.

FIELD OF THE INVENTION

The present invention relates generally to underground injection wells. Some embodiments of the invention involve the use of screen assemblies and various embodiments involve the use of an isolation flow assembly.

BACKGROUND OF THE INVENTION

In some downhole petroleum exploration and recovery operations, fluid is injected into the earthen formation from a perforated base pipe. Because of the potential for flowback of sand or other undesirable material (collectively referred to herein as "debris") into the base pipe, such as during periods of cessation of fluid injection, a screen assembly is commonly included. When the fluid is injected at high temperatures or velocities, the downhole equipment may be affected by the heated fluid. For example, the injection of high temperature steam in an injection well may cause the base pipe to expand and move longitudinally relative to an associated screen assembly that is confined by the adjacent formation and/or gravel packing. For another example, the high temperature fluid may cause damage or wear to the screen assembly.

There are times when it is beneficial or desirable to vary the injection flow rate or other flow characteristic at different times during the process. This may require or involve changing the size of the orifice(s) through which the fluid, such as steam, is injected through the base pipe. However, changing the injection orifice size typically requires removing the base pipe from its underground site, causing a significant loss of time and efficiency.

It should be understood that the above-described examples, features and/or disadvantages are provided for illustrative purposes only and are not intended to limit the scope or subject matter of the claims of this patent application or any patent or patent application claiming priority hereto. Thus, none of the appended claims or claims of any related application or patent should be limited by the above discussion or construed to address, include or exclude the cited examples, features and/or disadvantages, except and only to the extent as may be expressly stated in a particular claim.

Accordingly, there exists a need for apparatus and methods useful with underground fluid injection systems having one or more of the following attributes, capabilities or features: assists in protecting the screen member from damage due to contact with fluid as it is ejected from the base pipe; assists in protecting the screen member from damage due to contact with fluid as it is ejected from the base pipe even during thermal expansion of the base pipe in either direction; includes at least one deflector to assist in protecting the screen member from damage due to contact with fluid as it is ejected from the base pipe; assists in protecting exit ports in at least one deflector from damage due to contact with fluid as it is ejected from the base pipe; includes a screen that floats on the base pipe to allow longitudinal thermal expansion or other movement of the base pipe relative to the screen; allows longitudinal displacement of the base pipe and/or screen assembly relative to one another; assisting in protecting the fluid flow opening(s) of the base pipe and base pipe from clogging due to sand flowback; includes a remotely replaceable and variable base pipe fluid injection nozzle or choke; includes an isolation flow assembly; allows easily changing the injection orifice size; allows remotely changing the injection orifice size; includes a screen assembly having at least three layers including an outer protective shroud, middle filter media and inner deflector; includes a screen assembly that is robust; includes an inner deflector with a fluid flow port on either or both ends; includes a solid inner deflector with at least one port; includes at least one shear pin to preserve the positional relationship of the screen assembly and base pipe during installation; provides spacing of fluid exit holes along the string to optimize steam injection so that steam may reach the entire interval; is useful as a focus port steam injection well to heat up heavy oil; is capable of being used with steam heated to an example temperature of 330 degrees Celsius; is durable, long lasting and/or low maintenance; or a combination thereof.

BRIEF SUMMARY OF THE INVENTION

In some embodiments, the present invention involves apparatus for assisting in reducing flowback of debris from an earthen formation into an underground fluid injection system. These embodiments include a base pipe having at least one fluid flow opening through which fluid may be injected into the earthen formation. At least one screen member is disposed at least partially around the base pipe. The screen member(s) and the base pipe are longitudinally moveable relative to one another. The screen member is shielded from direct contact with fluid as it is ejected from the base pipe through the fluid flow opening. The screen member is capable of reducing flowback of debris into the fluid flow opening.

In various embodiments, the present invention involves a screen assembly useful with a base pipe of an underground fluid injection system, the base pipe having at least one fluid flow opening through which fluid may be injected into an earthen formation. The screen assembly includes at least one screen member and at least one deflector. The screen member is associated with the base pipe so that the screen member and the base pipe are longitudinally moveable relative to one another. The deflector is capable of shielding the screen member from direct contact with fluid as it is ejected from the base pipe. The screen member is capable of reducing flowback of debris into the fluid flow opening.

Certain embodiments of the invention involve a fluid injection system for use in an earthen formation. The fluid injection system includes a plurality of base pipes, screen members and deflectors. Each base pipe includes at least one fluid flow opening through which fluid may be injected into the earthen formation. At least one screen member is associated and in longitudinally moveable relationship with each base pipe. Each screen member is capable of preventing blockage of at least one fluid flow opening from debris flowback from the earthen formation. Each deflector is capable of shielding the screen member from direct contact with fluid as it is ejected from the base pipe. Each deflector includes at least one port in fluid communication with at least one fluid flow opening and at least one screen member, and is disposed a sufficient distance from the fluid flow opening to prevent direct alignment of the fluid flow opening with the screen member during operations.

Some embodiments of the invention involve an isolation flow assembly removably engageable with a base pipe of an underground fluid injection system. The base pipe includes at least one fluid flow opening through which fluid may be injected into the earthen formation from the base pipe. The isolation flow assembly is capable of varying at least one flow characteristic of fluid injected into the earthen formation from the base pipe, and includes at least one isolation member and at least one releasable locking assembly axially moveable within the base pipe. The isolation member includes at least one fluid flow passage. When the isolation flow assembly is engaged with the base pipe, the fluid flow passage is in fluid communication with, and has at least one dimension that differs from the dimensions of, the fluid flow opening(s) of the base pipe. The releasable locking assembly is releasably engageable with the base pipe.

There are embodiments of the invention that involve a method of assisting in reducing flowback of debris from an earthen formation into an underground fluid injection system. At least one base pipe and associated screen assembly is installed in the earthen formation. Fluid is injected from the base pipe through at least one fluid flow opening into a gap formed between the base pipe and a deflector. The deflector shields at least one screen member from direct contact with fluid as it is ejected through the fluid flow opening. The screen member reduces flowback of substantial debris from the earthen formation to a fluid flow opening.

Some embodiments of the invention involve a method of varying at least one flow characteristic of fluid injected into an earthen formation from a base pipe of an underground fluid injection system. At least one fluid flow passage is formed in an isolation member of an isolation flow assembly. The fluid flow passage has at least one dimension that differs from the dimensions of at least one fluid flow opening of the base pipe. The isolation flow assembly is inserted into the base pipe. At least one releasable locking mechanism of the isolation flow assembly is engaged with the base pipe. The fluid flow passage of the isolation member is in fluid communication with the fluid flow opening of the base pipe. Fluid is provided into the isolation flow assembly. The fluid passes from the isolation flow assembly to the base pipe through the fluid flow passage and exits the base pipe through its fluid flow opening.

Accordingly, the present invention includes features and advantages which are believed to enable it to advance injection well technology. Characteristics and advantages of the present invention described above and additional features and benefits will be readily apparent to those skilled in the art upon consideration of the following detailed description of preferred embodiments and referring to the accompanying drawings.

BRIEF DESCRIPTION OF THE DRAWINGS

The following figures are part of the present specification, included to demonstrate certain aspects of presently preferred embodiments of the invention and referenced in the detailed description herein.

DETAILED DESCRIPTION OF PRESENTLY PREFERRED EMBODIMENTS

Figure 1:
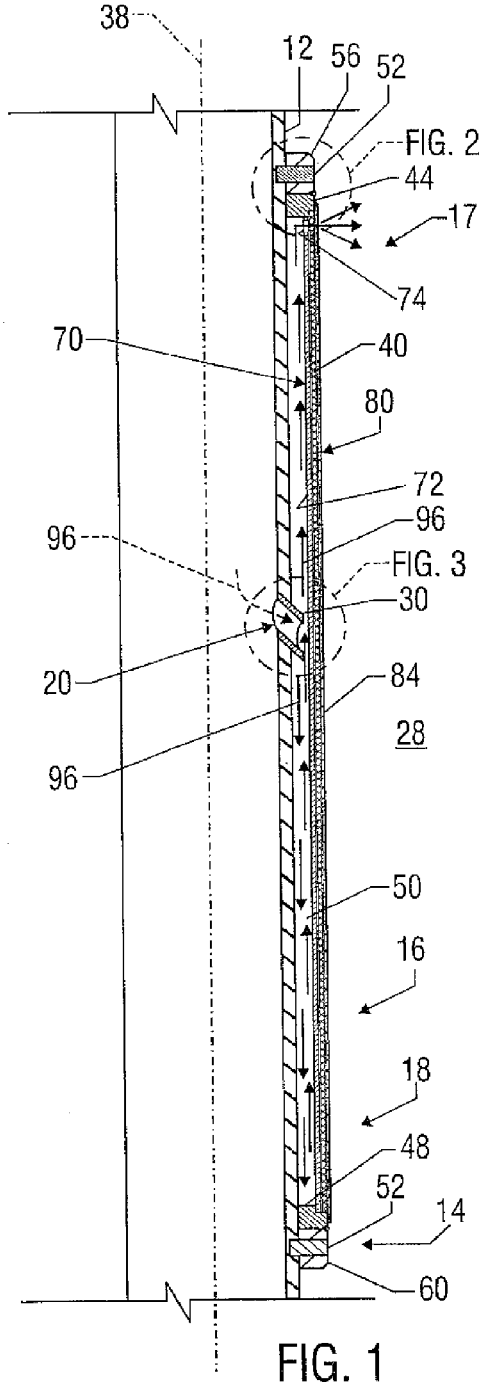
FIG. 1 is a partial cross-sectional view of an example base pipe and associated screen assembly in accordance with an embodiment of the present invention.

Characteristics and advantages of the present invention and additional features and benefits will be readily apparent to those skilled in the art upon consideration of the following detailed description of presently preferred embodiments of the claimed invention and referring to the accompanying figures. It should be understood that the description herein and appended drawings, being of preferred embodiments, are not intended to limit the appended claims or the claims of any patent or patent application claiming priority to this application. On the contrary, the intention is to cover all modifications, equivalents, and alternatives falling within the spirit and scope of the claims. Many changes may be made to the particular embodiments and details disclosed herein without departing from such spirit and scope.

In showing and describing the preferred embodiments, like or identical reference numerals are used to identify common or similar elements. The figures are not necessarily to scale and certain features and certain views of the figures may be shown exaggerated in scale or in schematic in the interest of clarity and conciseness.

As used herein and throughout various portions (and headings) of this patent application, the terms "invention", "present invention" and variations thereof are not intended to mean the invention of every possible embodiment of the invention or any particular claim or claims. Thus, the subject matter of each such reference should not be considered as necessary for, or part of, every embodiment of the invention or any particular claim(s) merely because of such reference. Also, it should be noted that reference herein and in the appended claims to components and aspects in a singular tense does not necessarily limit the present invention to only one such component or aspect, but should be interpreted generally to mean one or more, as may be suitable and desirable in each particular instance.

Referring initially to FIG. 1, in accordance with an embodiment of the present invention, a perforated base pipe 12 useful in a downhole fluid injection system is shown having a screen assembly 16 associated therewith. In this example, the base pipe 12 has a single fluid flow opening 20 (see also FIG. 3) through which fluid, such as steam, is injectable into an adjacent earthen formation 28. In other embodiments, the base pipe 12 may include multiple fluid flow openings 20, while certain embodiments may include multiple screen assemblies 16 associated with a single base pipe 12. Depending upon the application, the fluid may have any desired composition and characteristics. For example, the fluid may include water, steam, one or more chemical or solid, or a combination thereof. The fluid is in no way limiting upon the present invention.

The fluid flow opening 20 may have any desired form, configuration and orientation. In some embodiments, the fluid flow opening may be an angled or non-angled orifice (not shown) formed in the base pipe. In other embodiments, the fluid flow opening may include any desired component(s) having any suitable material construction, form and arrangement to provide wear resistance, injection control or other desired purpose. In FIG. 1, for example, the fluid flow opening 20 is shown angled at approximately 45 degrees in the direction of the lower end 14 of the base pipe 12, and includes a nozzle 30 constructed of wear-resistant material, such as tungsten carbide, screwed into the base pipe 12 and protruding therefrom. However, the fluid flow opening 20 may be provided at any desired angle.

Figure 4:
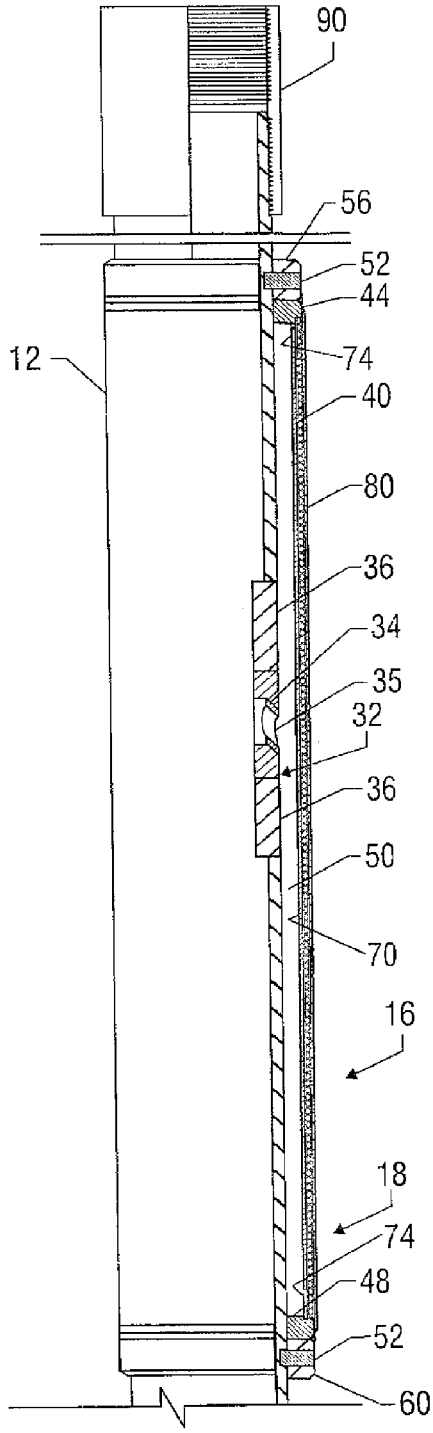
FIG. 4 is a partial cross-sectional view of an example base pipe and associated screen assembly in accordance with another embodiment of the present invention.

In the embodiment of FIG. 4, a replaceable choke 32 is removably engaged with the base pipe 12. The choke 32 does not disturb or affect the base pipe 12/screen assembly 16 arrangement. The choke 32 and related components may have any suitable construction, form and configuration. The exemplary choke 32 includes a mandrel 34 having a predetermined-sized flow orifice 35, sealing members (not shown) above and below the orifice 35 and a mechanical locking device (not shown). The locking device, such as a wireline lock, may be used for engaging the choke 32 into upper and lower sealing profile members 36 formed into the base pipe 12 and allowing retrieval and removal of the choke 32. The exemplary choke 32 may be installed on the surface during assembly or remotely by wireline or pipe. Accordingly, the fluid injection scheme of the base pipe 12 may be changed during operations by replacing the choke 32.

Referring back to FIG. 1, the screen assembly 16 includes at least one screen member 40 (see also FIGS. 2 and 3) capable of blocking, or preventing, flowback of debris from the earthen formation 28 into the fluid flow opening 20 and base pipe 12. This feature may be useful, for example, during cessation of fluid injection from the base pipe 12 into the earthen formation. The screen member(s) 40 may have any suitable form, construction and configuration. For example, the screen member 40 may be a cylindrical wire wrap screen, mesh laminate, metal mesh or other filter media or material as is or become known. If desired, the screen member 40 may include multiple layers of filter media.

The screen assembly 16 is associated with the base pipe 12 in a manner that permits relative movement of the screen member 40 and base pipe 12 along the longitudinal axis 38 of the base pipe 12. Thus, the base pipe 12 may move longitudinally during operations without disturbing the screen member 40. For example, the screen member 40 or one or more related component may be shrunk fit onto the base pipe 12, as is or becomes known. The illustrated embodiment includes a pair of shrink-fit rings 44, 48 rigidly connected, such as by weld, to the screen member 40 and shrunk fit onto and in generally slideable sealing engagement with the base pipe 12 sufficient to maintain a desired seal and allow relative longitudinally movement therebetween. With this arrangement, under certain forces on the base pipe 12 and/or screen member 40, the base pipe 12 is capable of moving or expanding in either direction along its longitudinal axis 38 relative to the screen member 40.

One or more shear pin 52 that is releasably engageable between the base pipe 12 and screen assembly 16 or screen member 40 may be included. In the example of FIG. 1, upper and lower end rings 56, 60, each carrying a shear pin 52, are disposed around and longitudinally slideable over the base pipe 12. The illustrated end rings 56, 60 are rigidly connected, such as by weld, with the upper and lower shrink fit rings 44, 48, respectively (See also FIG. 2). The exemplary shear pins 52 maintain the positional relationship of the screen assembly 16 and base pipe 12 during installation, or deployment, of the base pipe 12, and thereafter will shear, or break away from the base pipe 12, under certain operating conditions.

Figure 2:
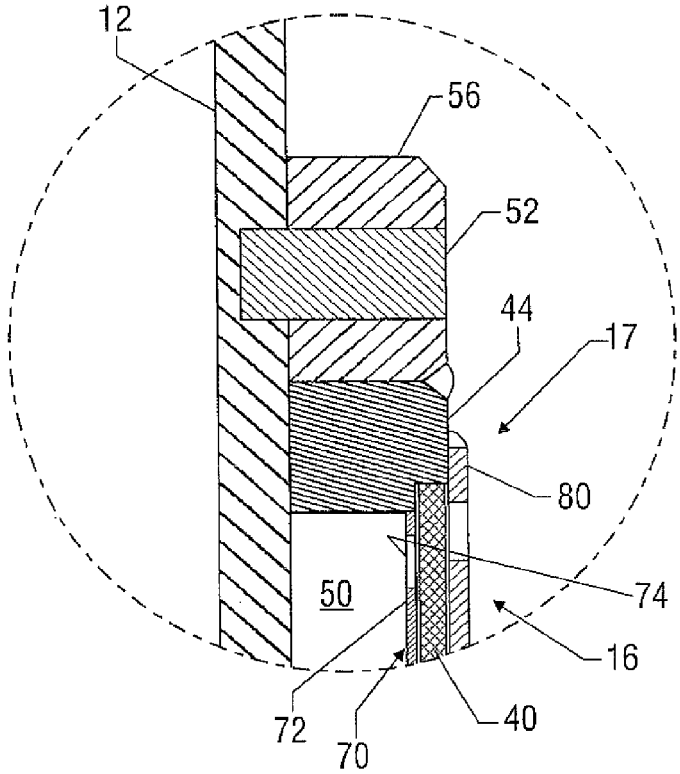
FIG. 2 is an enlarged cross-sectional view of the upper end of the screen assembly of the embodiment of FIG. 1.
Figure 3:
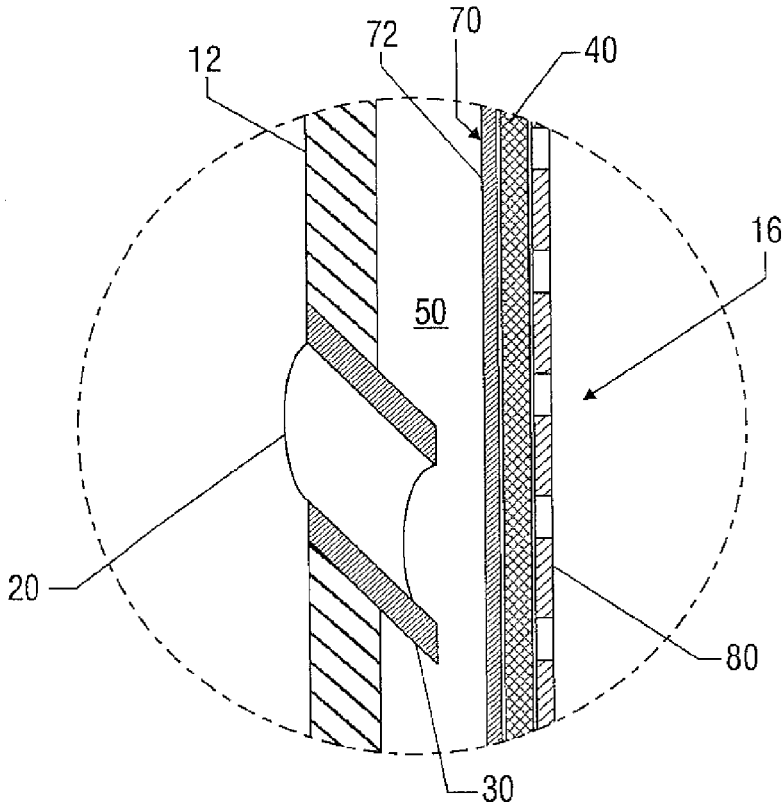
FIG. 3 is an enlarged cross-sectional view of the fluid flow opening of the base pipe and the adjacent screen assembly of the embodiment of FIG. 1.

Still referring to FIG. 1, the screen assembly 16 may also include a deflector 70 disposed at least partially between the base pipe 12 and the screen member 40 (see also FIGS. 2, 3). The deflector 70 may be useful, for example, to assist in protecting the screen member 40 from substantial damage by direct contact with fluid ejected through the fluid flow opening 20.

The deflector 70 may have any suitable form, configuration and orientation. In the embodiment shown, the deflector 70 is a generally solid tubular member 72 constructed of stainless steel and spanning substantially the entire length of the screen member 40. The illustrated deflector 70 is rigidly connected, such as by weld, to the upper and lower shrink fit rings, 44, 48 and is axially spaced from the base pipe 12 and screen member 40. The deflector 70 includes a port 74 to allow fluid injected from the fluid flow opening 20 into a gap 50 formed between the base pipe 12 and the deflector 70 to pass through the screen member 40 and into the earthen formation 28.

If desired, at assembly, the port 74 may be located in the deflector 50 a sufficient distance from the fluid flow opening 20 to prevent any occurrence of direct alignment of the fluid flow opening 20 with the port 74 and/or screen member 40 during operations. In FIGS. 1 and 2, the port 74 is positioned near the upper end 17 of the screen assembly 16 and spaced from the fluid flow opening 20 (at assembly) a distance estimated to be sufficient to avoid direct alignment therebetween prior to, during and after maximum possible relative longitudinal displacement of the base pipe 12 and screen assembly 16. For example, when the maximum expected thermal expansion of the base pipe 12 is between four and five feet in either direction, a pre-deployment distance between the port 74 and the fluid flow opening 20 of over five feet will prevent direct contact of the port 74, or screen member 40, by fluid as it is ejected through the fluid flow opening 20.

In some embodiments, the deflector 70 may include two or more ports. For example, in FIG. 4, a second port 74 is formed in the deflector 70 similarly distanced from the fluid flow opening 20 as the first port 74, but near the bottom end 18 of the screen assembly 16. Further, when multiple screen assemblies 16 are used with a string of connected base pipes 12 in an injection system, the ports 74 may be formed into the respective deflectors 70 with spacing to assist in achieving optimal fluid injection across the desired interval of earthen formation. For example, a port 74 may be located approximately every fifty meters in the injection system to effectively heat heavy oil or bitumen in the earthen formation.

However, the deflector 70 may take any other suitable form and configuration. For example, the deflector 70 may be a small plate (not shown) disposed in the proximity of the fluid flow opening(s) 20 between the base pipe 12 and screen member 40.

Referring again to FIG. 1, the screen assembly 16 may also include a perforated outer shroud 80 extending along the outer surface of the screen member 40, such as to assist in protecting the screen member 40 during deployment and/or operations. The outer shroud 80 may take any suitable form and configuration as is or becomes known. In the embodiment shown, the outer shroud 80 is a tube-shaped member 84 constructed of stainless steel. The tube-shaped member 84 is rigidly engaged with the upper and lower shrink fit rings, 44, 48, such as by weld, and axially spaced from the screen member 40.

In the embodiment of FIG. 1, the upper and lower end rings 56, 60, upper and lower shrink fit rings 44, 48, screen member 40, deflector 70 and outer shroud 80 move in unison relative to the base pipe 12. If desired, one or more stop member may be included to stop the relative movement of the base pipe 12 and screen assembly 16. For example, the stop member may be the collar 90 (FIG. 4) located proximate to one or both ends of the base pipe 12, a stop ring (not shown) or other component.

Figure 5:
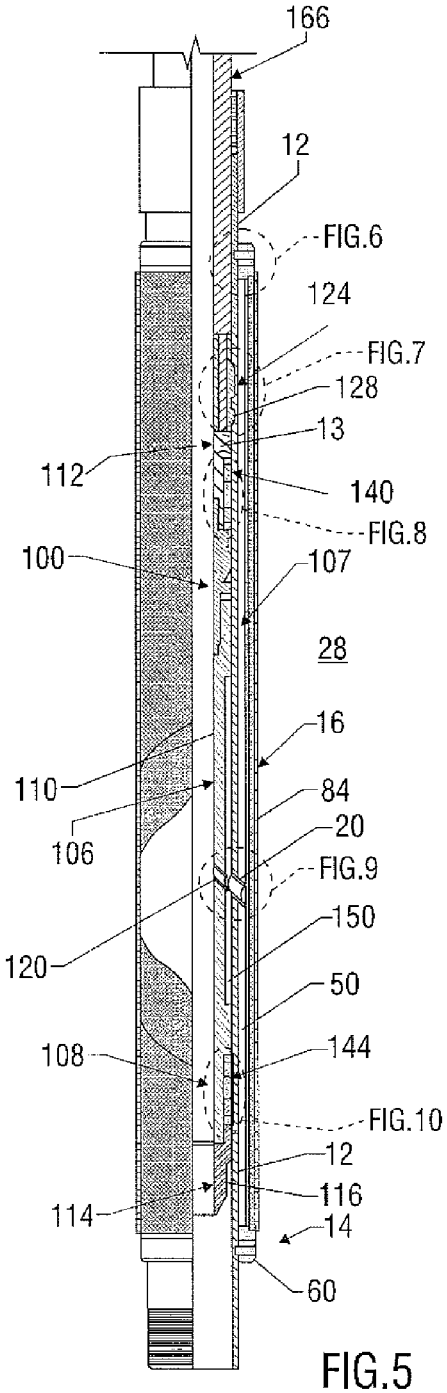
FIG. 5 is a partial cross-sectional view of an example base pipe, associated screen assembly and isolation flow assembly in accordance with an embodiment of the present invention.
Figure 6:
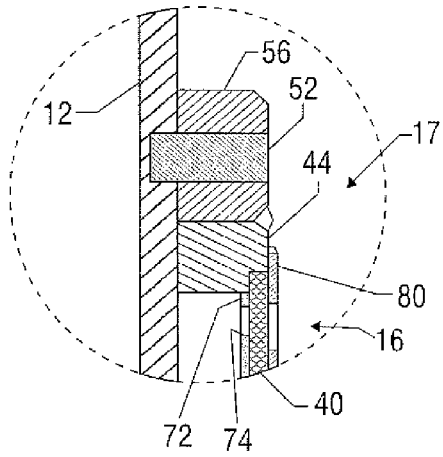
FIG. 6 is an enlarged cross-sectional view of the upper end of the exemplary screen assembly of the embodiment of FIG. 5.

Now referring to the embodiment of FIG. 5, a replaceable isolation flow assembly 100 is insertable into and removably engageable with the base pipe 12. The isolation flow assembly 100 does not disturb or affect the relationship of the base pipe 12 and screen assembly 16. FIG. 6, for example, shows the screen assembly 16 and base pipe 12 arranged similarly as shown in the embodiment of FIG. 1 and described above.

Figure 9:
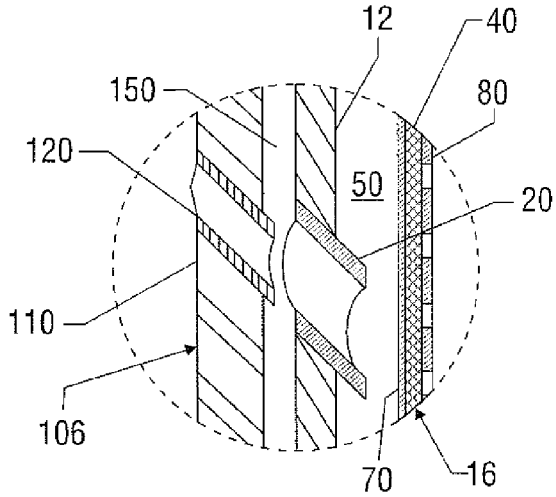
FIG. 9 is an enlarged cross-sectional view of the fluid flow passage of the exemplary isolation member and adjacent fluid flow opening of the exemplary base pipe of the embodiment of FIG. 5.

The isolation flow assembly 100 and related components may have any suitable form, configuration and construction. In this example, the isolation flow assembly 100 includes an isolation member 106 and releasable locking assembly 112. The isolation member 106 is a tube-shaped mandrel 110 having a fluid flow passage 120 in fluid communication with the fluid flow opening 20 of the base pipe 12 when the isolation flow assembly 100 is engaged with the base pipe 12 (see also FIG. 9). Thus, the fluid injection scheme of the exemplary system may be changed based upon the size of the fluid flow passage 120 by installing or replacing the isolation flow assembly 100.

In the illustrated example, the fluid flow passage 120 is smaller than, and aligned with, the angularly oriented fluid flow opening 20. However, the present invention is not limited to this particular configuration—one or more fluid flow passage 120 of any desirable size and construction may be aligned as desired with one or more fluid flow opening 20 of the base pipe 12. Furthermore, the fluid flow passage 120 may have any desired form, configuration and orientation, and may include a nozzle or other desired components.

A guide member 114 may be included below the isolation member 106 to assist in guiding or positioning the isolation flow assembly 100 in the base pipe 12. For example, the guide member 114 may be a tube-shaped guide nose 116 threadably engaged with the lower end 108 of the isolation member 106.

Still referring to FIG. 5, the locking assembly 112 of this embodiment allows engagement and disengagement of the isolation flow assembly 100 and base pipe 12. In this example, the locking assembly 112 is threadably engaged with the upper end 107 of the isolation member 106 and includes a locking mechanism 124 engageable with the inner surface 13 of the base pipe 12. The locking mechanism 124 may have any suitable form and configuration. For example, referring to FIG. 7, the locking mechanism 124 may be an X-lock 128, such as the presently commercially available "TICX Locking Mandrel" by Tools International Company (TIC), which is constructed and operates as is known in the art. The example X-lock 128 includes two spring-biased keys 130 releasably mateable with profiles 134 formed or positioned at different locations on the inner circumference of the base pipe 12. If desired, the profiles 134 may be formed in one or more separate component (not shown) engaged with the base pipe 12.

Figure 8:
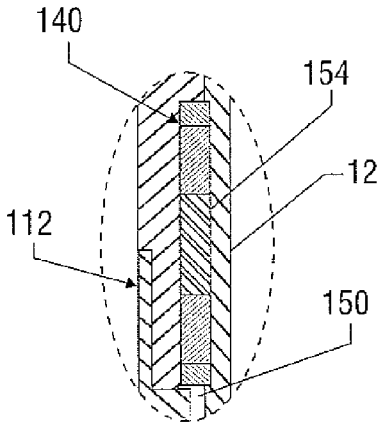
FIG. 8 is an enlarged cross-sectional view of an exemplary upper sealing assembly of the embodiment of FIG. 5.
Figure 10:
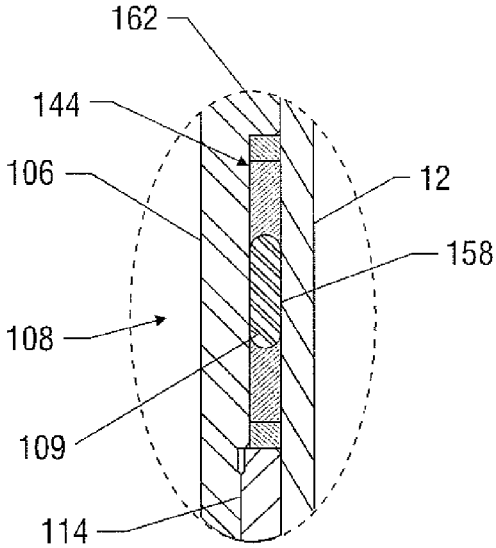
FIG. 10 is an enlarged cross-sectional view of an example lower sealing assembly of the embodiment of FIG. 5.

Referring again to FIG. 5, the isolation flow assembly 100 of this embodiment also includes upper and lower sealing assemblies 140, 144. The illustrated sealing assemblies 140, 144 are capable of providing seals proximate to the upper and lower ends of a gap 150 formed between the isolation member 106 and the base pipe 12. The sealing assemblies 140, 144 may have any suitable form, configuration and construction. For example, referring to FIG. 8, the illustrated upper sealing assembly 140 is a packing stack 154 carried by the locking assembly 112. The illustrated lower sealing assembly 144, as shown in FIG. 10, is a packing stack 158 disposed in a space, or groove, 162 at the lower end 108 of the isolation member 106. In this example, the space 162 is disposed around a shoulder 109 of the isolation member 106 and between the isolation member 106 and the guide member 114. The exemplary guide member 114 thus assists in containing the packing stack 158. Each packing stack 154, 158 includes one or more sealing member constructed of any suitable desirable material, as is or becomes know.

In an example method involving use of the embodiment of FIG. 1 in an underground steam injection system, the base pipe 12 with screen assembly 16 is deployed into the earthen formation 28, such as via a borehole, as is or becomes known. During typical deployment, the shear pins 52 maintain engagement of the screen assembly 16 and base pipe 12 to prevent relative movement therebetween. As desired, steam is ejected from the base pipe 12 through the fluid flow opening 20 and into the gap 50. The port(s) 74 in the deflector 70 allow fluid to flow from the gap 50 through the screen member 40 and into the earthen formation 28. In this particular arrangement having a downwardly-oriented fluid flow opening 20, the steam will be expected, at least initially, to move toward the lower end 18 of the screen assembly 16 and thereafter toward the upper end 17 before exiting the port 74, such as in the example flow pattern shown with arrows 96.

The exemplary deflector 70 shields the screen member 40 from direct contact by fluid as it is ejected through the fluid flow opening 20. Upon a particular magnitude of thermal expansion of the base pipe 12 and/or restraint of the screen assembly 16 by formation collapsing and/or gravel-packing, the shear pin 52 will shear, allowing the base pipe 12 to move longitudinally relative to the end rings 44, 48 and screen assembly 16 without the assistance of an electric motor or shifting tool. Prior to, at and after maximum projected thermal expansion or longitudinal displacement of the base pipe 12, the fluid flow opening 20 will not align with the port(s) 74 of the deflector 70. The deflector 70 will continue to shield the screen member 40 from direct contact by fluid as it is ejected through the fluid flow opening 20. During cessation of fluid ejection through the fluid flow opening 20, the screen member 40 will prevent substantial flowback of debris through the port(s) 74, into the gap 50, fluid flow opening 20 and base pipe 12. However, the present invention is not limited by the above application or operation.

Figure 7:
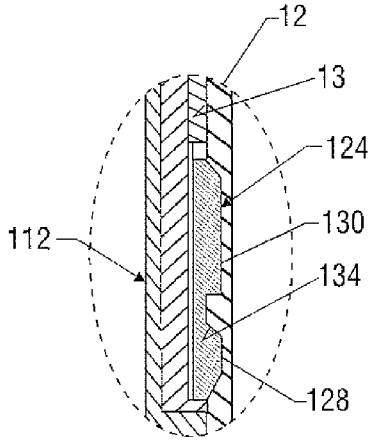
FIG. 7 is an enlarged cross-sectional view of an example locking mechanism of the embodiment of FIG. 5.

An example method of use of the embodiment of the isolation flow assembly 100 of FIG. 5 in an underground steam injection system will now be described. When it is desired to connect the isolation flow assembly 100 to the base pipe 12, the isolation flow assembly 100 is run into the base pipe 12, such as with the use of a wireline, or pipe, 166 connected to the upper end of the isolation flow assembly 100, as is or becomes know. The guide member 114, when included, assists in guiding the isolation flow assembly 100 into the base pipe 12 to the desired position. When the assembly 100 is located at the desired position within the base pipe 12, one or more locking mechanisms 124 are secured to the base pipe 12. In the illustrated embodiment, as shown in FIG. 7, each spring biased key 130 engages the corresponding mating profile 134 provided on the inner circumference of the base pipe 12. Fluid, such as steam, is injected into the isolation member 106 and out through its fluid flow passage 120, the through the fluid flow opening 20 of the base pipe 12 and the screen assembly 16 into the earthen formation 28. When it is desired to disconnect the isolation flow assembly 100 from the base pipe 12, the one or more locking mechanisms 124 are disengaged from the base pipe 12. A wireline or pipe 166 connected to the upper end of the isolation flow assembly 100 may be used to draw the isolation flow assembly 100 out of the base pipe 12.

Preferred embodiments of the present invention thus offer advantages over the prior art and are well adapted to carry out one or more of the objects of the invention. However, the present invention does not require each of the components and acts described above and is in no way limited to the above-described embodiments, methods of operation, variables, values or value ranges. Any one or more of the above components, features and processes may be employed in any suitable configuration without inclusion of other such components, features and processes. Moreover, the present invention includes additional features, capabilities, functions, methods, uses and applications that have not been specifically addressed herein but are, or will become, apparent from the description herein, the appended drawings and claims.

The methods described above and claimed herein and any other methods which may fall within the scope of the appended claims can be performed in any desired suitable order and are not necessarily limited to the sequence described herein or as may be listed in the appended claims. Further, the methods of the present invention do not necessarily require use of the particular embodiments shown and described in the present application, but are equally applicable with any other suitable structure, form and configuration of components.

While preferred embodiments of the invention have been shown and described, many variations, modifications and/or changes of the system, apparatus and methods of the present invention, such as in the components, details of construction and operation, arrangement of parts and/or methods of use, are possible, contemplated by the patent applicant(s), within the scope of the appended claims, and may be made and used by one of ordinary skill in the art without departing from the spirit or teachings of the invention and scope of appended claims. Thus, all matter herein set forth or shown in the accompanying drawings should be interpreted as illustrative, and the scope of the invention and the appended claims should not be limited to the embodiments described and shown herein.

What is claimed:

1. An isolation flow assembly removably engageable with a base pipe of an underground fluid injection system, the base pipe being positionable within or adjacent to an underground earthen formation and having at least one fluid flow opening through which fluid may be injected from the base pipe into the earthen formation, the isolation flow assembly being capable of varying at least one flow characteristic of fluid injected into the earthen formation from the base pipe, the isolation flow assembly comprising:

an isolation member axially moveable within the base pipe, said isolation member having at least one fluid flow passage, said at least one fluid flow passage having at least one dimension that differs from the dimensions of the at least one fluid flow opening of the base pipe, said at least one fluid flow passage being in fluid communication with at least one fluid flow opening of the base pipe when the isolation flow assembly is engaged with the base pipe, wherein a gap is formed between said isolation member and the base pipe;

at least one sealing assembly disposed adjacent to said gap; and a releasable locking assembly connected with said isolation member and axially moveable within and releasably engageable with the base pipe, whereby at least one flow characteristic of fluid injected into the earthen formation from the base pipe may be varied by moving said isolation member and said releasable locking assembly into the base pipe and either engaging said releasable locking assembly with the base pipe or disengaging said releasable locking assembly from the base pipe and removing said isolation member and said releasable locking assembly from the base pipe.

2. The isolation flow assembly of claim 1, wherein said at least one fluid flow passage includes one fluid flow passage and the at least one fluid flow opening includes one fluid flow opening.

3. The isolation flow assembly of claim 2, wherein the diameter of said fluid flow passage is smaller than the diameter of the fluid flow opening.

4. The isolation flow assembly of claim 1, wherein said at least one sealing assembly includes a first packing stack capable of sealing said gap above said at least one fluid flow passage and a second packing stack capable of sealing said gap below said at least one fluid flow passage.

5. The isolation flow assembly of claim 4, further including a guide member disposed at the lower end of said isolation member, said guide member being capable of assisting in guiding movement of said isolation member into the base pipe.

6. The isolation flow assembly of claim 5, wherein said second packing stack is disposed between said guide member and said isolation member.

7. The isolation flow assembly of claim 4, wherein said first packing stack is carried by said releasable locking assembly.

8. The isolation flow assembly of claim 1, wherein said releasable locking assembly includes at least one spring-biased key that is remotely releasably mateable with at least one profile provided on the interior of the base pipe, whereby said releasable locking assembly is remotely engageable and disengageable with the base pipe.

9. A method of varying at least one flow characteristic of fluid injected into an earthen formation from a base pipe of an underground fluid injection system, the base pipe having at least one fluid flow opening through which fluid may be injected from the base pipe into the earthen formation, the method comprising:

forming at least one fluid flow passage in an isolation member of an isolation flow assembly, the at least one fluid flow passage having at least one dimension that differs from the dimensions of the at least one fluid flow opening of the base pipe;

providing at least one sealing assembly with the isolation flow assembly;

forming a gap between the isolation flow assembly and the base pipe; and the at least one sealing assembly sealing an end of the gap;

inserting the isolation flow assembly into the base pipe;

engaging at least one releasable locking mechanism of the isolation flow assembly with the base pipe;

the at least one fluid flow passage of the isolation member being in fluid communication with at least one fluid flow opening of the base pipe;

providing fluid into the isolation flow assembly; and the fluid passing from the isolation flow assembly to the base pipe through the at least one passage and existing the base pipe through the at least one fluid flow opening.

10. The method of claim 9, further including remotely disengaging the at least one releasable locking assembly from the base pipe and removing the isolation flow assembly from the base pipe.

11. An isolation flow assembly removably engageable with a base pipe of an underground fluid injection system, the base pipe being positionable within or adjacent to an underground earthen formation and having at least one fluid flow opening through which fluid may be injected from the base pipe into the earthen formation, the isolation flow assembly being capable of varying at least one flow characteristic of fluid injected into the earthen formation from the base pipe, the isolation flow assembly comprising:

an isolation member axially moveable within the base pipe, said isolation member having at least one fluid flow passage, said at least one fluid flow passage having at least one dimension that differs from the dimensions of the at least one fluid flow opening of the base pipe, said at least one fluid flow passage being in fluid communication with at least one fluid flow opening of the base pipe when the isolation flow assembly is engaged with the base pipe; and a releasable locking assembly connected with said isolation member and axially moveable within and releasably engageable with the base pipe, wherein said releasable locking assembly includes at least one spring-biased key that is remotely releasably mateable with at least one profile provided on the interior of the base pipe, whereby said releasable locking assembly is remotely engageable and disengageable with the base pipe, whereby at least one flow characteristic of fluid injected into the earthen formation from the base pipe may be varied by moving said isolation member and said releasable locking assembly into the base pipe and either engaging said releasable locking assembly with the base pipe or disengaging said releasable locking assembly from the base pipe and removing said isolation member and said releasable locking assembly from the base pipe.

12. The isolation flow assembly of claim 11, wherein a gap is formed between said isolation member and the base pipe, further including at least one sealing assembly disposed adjacent to said gap.

13. The isolation flow assembly of claim 12, wherein said at least one sealing assembly includes a first packing stack capable of sealing said gap above said at least one fluid flow passage and a second packing stack capable of sealing said gap below said at least one fluid flow passage.

14. The isolation flow assembly of claim 13, further including a guide member disposed at the lower end of said isolation member, said guide member being capable of assisting in guiding movement of said isolation member into the base pipe.

15. The isolation flow assembly of claim 14, wherein said second packing stack is disposed between said guide member and said isolation member.

16. The isolation flow assembly of claim 13, wherein said first packing stack is carried by said releasable locking assembly.

* * * * *